United States Patent [19]

Blain

[11] Patent Number: 4,610,611

[45] Date of Patent: Sep. 9, 1986

[54] SCROLL TYPE POSITIVE DISPLACEMENT APPARATUS WITH TENSION RODS SECURED BETWEEN SCROLLS

[75] Inventor: Edward S. Blain, Rockford, Ill.

[73] Assignee: Sundstrand Corporation, Rockford, Ill.

[21] Appl. No.: 787,319

[22] Filed: Oct. 15, 1985

[51] Int. Cl.[4] ..... F01C 1/04; F01C 21/00; F16D 3/00

[52] U.S. Cl. ..... 418/55; 418/57; 403/291

[58] Field of Search ..... 418/55, 57; 403/291; 464/97, 155

[56] References Cited

U.S. PATENT DOCUMENTS

| | | | |
|---|---|---|---|
| 2,324,168 | 7/1943 | Montelius | 418/55 |
| 3,600,114 | 8/1971 | Dvorak et al. | 418/55 |
| 3,817,664 | 6/1974 | Bennett et al. | 418/55 |
| 3,918,852 | 11/1975 | Carter | 417/424 |
| 4,330,029 | 5/1982 | Noll et al. | 464/97 |

FOREIGN PATENT DOCUMENTS

| | | | |
|---|---|---|---|
| 427656 | 6/1911 | France | 418/55 |
| 980737 | 1/1951 | France | 418/55 |

*Primary Examiner*—John J. Vrablik

*Attorney, Agent, or Firm*—Wood, Dalton, Phillips, Mason & Rowe

[57] ABSTRACT

Axial separation of the scrolls 10, 12 in a positive apparatus of the scroll type is resisted by provision of a elongated, tension rod 44. Hollow shafts 20, 24; 30, 32 coupled to the scrolls 10, 12 receive opposed ends 46, 48 of the rod 44 which are fixedly secured thereto in non-rotatable relation. The rod 44 extends through the interface 14 between the scrolls 10, 12 via apertures 26 and 40 and resists axial separating forces present at the interface 14.

7 Claims, 1 Drawing Figure

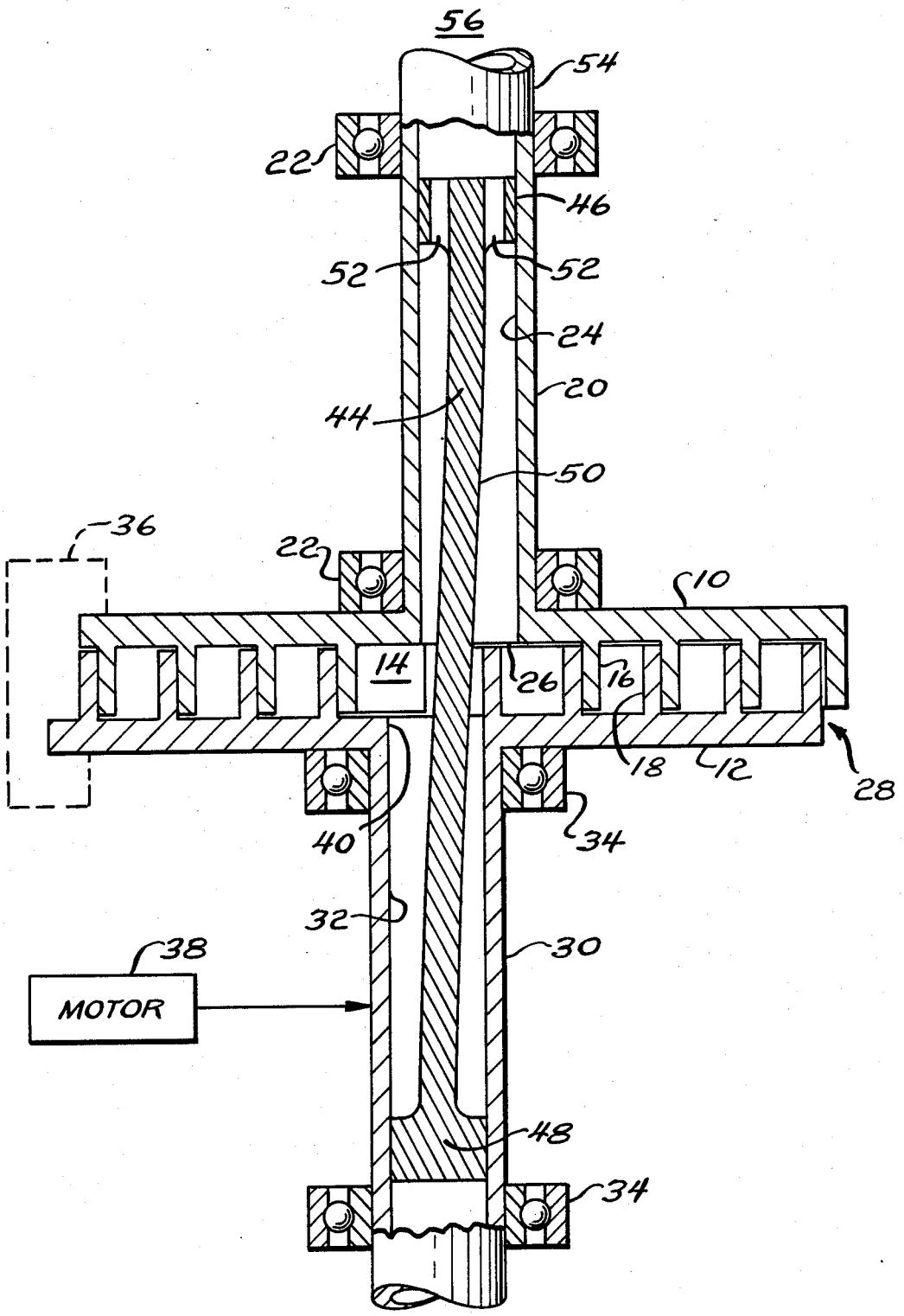
56
54
22
46
52
52
24
20
44
50
36
22
10
14
26
16
18
12
28
40
34
32
30
38
MOTOR
48
34

SCROLL TYPE POSITIVE DISPLACEMENT APPARATUS WITH TENSION RODS SECURED BETWEEN SCROLLS

FIELD OF THE INVENTION

This invention relates to positive displacement apparatus, and more particularly, to positive displacement apparatus of the scroll type.

BACKGROUND OF THE INVENTION

Scroll type positive displacement apparatus have attracted a great deal of interest for any of a variety of reasons including theoretical simplicity, the ability to generate very high pressures or expand relatively large volumes with an apparatus that is physically quite small, and the fact that scroll type apparatus lend themselves to multi-stage configurations.

As is well known, scroll type apparatus are generally comprised of a pair of flat plates in generally parallel relation with each plate having one or more spiral vanes extending axially toward the other plate to interfit with a vane or vanes thereon. Depending upon the design, both plates may be rotated with one additionally orbiting with respect to the other or one plate may be merely orbited with respect to the other which is stationary. In either event, closed pockets defined by points of contact of the vanes travel between radially inner and radially outer locations along the interface between the plates and serve to convey fluid between ports disposed at such locations.

When used as a compressor or a pump, the radially outer port will be an inlet port, while the radially inner port, frequently formed in a shaft supporting one of the scrolls, will be an outlet port. When used as an expander, the arrangement is the reverse.

In either event, a high pressure area is disposed centrally of the plates, that is, at the radially inner port, either due to the presence of the fluid being compressed at that location or the admission of the fluid under high pressure to be expanded to a lower pressure at such location. The relatively high pressure tends to drive the plates axially apart. Should the plates move appreciably apart in the the axial direction, the ability to seal the pockets is lost as is the efficiency of operation of the apparatus.

Consequently, the prior art has proposed preloading the plates towards each other in the axial direction. However, when it is desired to start up the preloaded apparatus, the large frictional forces existing at the points of contact between the scrolls make the apparatus hard to start.

To avoid this difficulty, the prior art has proposed to the application of the high pressure at the radially inner port to the side of either or both of the scrolls opposite the interface so as to act oppositely of the high pressure at the area centrally of the interface which tends to separate the plates. In other words, existing high pressure is utilized to balance the high pressure at the interface prevents separation.

This approach, while successful, has been implemented only at the expense of complexity and bulk in terms of requiring the presence of chambers to receive the balancing pressure and direct the same against the scrolls oppositely of the interface, various seals, etc.

The present invention is directed to the provision of simplified means for preventing axial separation of the scrolls during operation in the scroll-type apparatus.

SUMMARY OF THE INVENTION

It is the principal object of the invention to provide a new and improved positive displacement apparatus of the scroll type. More specifically, it is an object of the invention to provide such an apparatus wherein axial separation of the scrolls is resisted by means of simple construction and which are of long life.

An exemplary embodiment of the invention achieves the foregoing object in a positive displacement apparatus of the scroll type including first and second scrolls in side-by-side relation. Each scroll has at least one generally spiral-shaped vane and the vanes interfit to define at least one closed pocket at the interface of the scrolls. The pocket is movable between ports at positions centrally of the scroll and peripherally thereof. Means are provided for mounting the scrolls so that one scroll at least orbits with respect to the other to move the pocket between the ports and means are provided for orbiting the one scroll. According to the invention, a tension rod extends between the scrolls and has its opposite ends fixedly secured to respective ones of the scrolls.

As a consequence of this construction, axial separation of the scrolls is resisted by the tension rod. At the same time, because the tension rod is fixedly secured to the scrolls, there are no moving parts involved in the axial separation preventing structure, which is a picture of utter simplicity.

According to a preferred embodiment of the invention, the rod is located centrally of the scrolls.

In a highly preferred embodiment, the rod is elongated and extends to either side of the scrolls.

In one embodiment of the invention, the scrolls are not only mounted for relative orbiting movement, but for rotation as well and each includes a hollow shaft secured thereto generally centrally of the corresponding scroll. The tension rod is disposed in respective ones of the hollow shafts at locations remote from the interface.

According to the preferred embodiment of the invention, one of the shafts and the rod defines a relief intermediate the ends of the rod so that the rod will not abut the shafts or the scrolls as the one scroll orbits with respect to the other during operation of the apparatus. In a highly preferred embodiment, such a relief is defined by a reduced diameter portion on the rod located intermediate the ends thereof.

The invention contemplates that one of the hollow shafts opens to the interface by an aperture which in turn serves as one of the ports. The hollow shaft thus serves as a conduit to such port and in this embodiment, the end of the rod secured within the shaft is enlarged and includes at least one passage in fluid communication with the interior of the hollow shaft.

Other objects and advantages will become apparent from the following specification taken in connection with the drawings.

DESCRIPTION OF THE DRAWINGS

The FIGURE is a sectional view of a positive displacement apparatus of the scroll-type made according to the invention.

DESCRIPTION OF THE PREFERRED EMBODIMENT

An exemplary embodiment of positive displacement scroll-type apparatus made according to the invention is illustrated in the FIGURE and with reference thereto is seen to include first and second side by side, generally parallel scroll plates 10 and 12 respectively. At their interface 14, the scroll plates 10 and 12 respectively have one or more generally spiralled, interfitting vanes 16 and 18 which, as is well known, ultimately define sealed pockets for containing a working fluid. The configuration of the vanes 16 and 18 is well known and forms no part of the present invention. It is sufficient to say that during operation of the apparatus, the vanes 16 and 18 define one or more pockets at the interface 14 which move between radially inner and radially outer positions on such interface 14.

The scroll plate 10 is mounted on a hollow shaft 20 which in turn is journalled by bearings 22. The shaft 20 has a central bore 24 which opens to the interface 14 at an aperture 26 which in turn serves as a central port at the interface 14. The aperture 26 thus serves as an outlet when the apparatus is used as a compressor or a pump and as an inlet when used as an expander.

Radially outwardly from the aperture 26, and at the periphery of the interface 14, is a further port shown generally at 28 which, when the apparatus is used as a pump or a compressor, acts as an inlet port and which, when the apparatus is used as an expander, acts as an outlet port.

The scroll plate 12 is likewise mounted on a shaft 30 having a central bore 32 and which is journalled by bearings 34.

Any one of a variety of known forms of linkages shown schematically at 36 may be employed to link the shafts 20 and 30 (or the scroll plates 10 and 12) so that the scroll plates 10 and 12 may rotate simultaneously within their respective bearings 22 and 34 and such that one of the scroll plates 10 or 12 undergoes orbital movement with respect to the other of the scroll plates.

Linkages of the sort employed at 36 are well known and form no part of the present invention.

To rotate the components and to cause relative orbiting movement, a motor 38 is coupled to the shaft 30.

It will be seen that the bore 32 in the shaft 30 opens to the interface 14 at an aperture 40 and that the apertures 26 and 40 are offset from one another, that is, the bores 24 and 32 are not co-axial.

Disposed within the bores 24 and 32 is an elongated tensioning rod 44. As can be seen, the tensioning rod 44 has enlarged ends 46 and 48 separated by a reduced diameter portion 50 which serves as a relief. The enlarged ends 46 and 48 are fixedly and nonrotatably secured to the associated shafts 20 and 30 by any suitable means, as, for example, pinning, welding, brazing, etc.

As a consequence of this construction, forces tending to axially separate the scrolls 10 and 12 are conveyed to the rod 44 to place the same in tension and the rod 44 resists such axial separation in a satisfactory fashion. During operation of the apparatus, the relative orbital movement between the scrolls 10 and 12 causes the rod 44 to bend or flex intermediate its ends 46 and 48. However, such bending occurs without the rod 44 contacting the scrolls 10 or 12 by reason of the reduced diameter portion 50 intermediate the ends 46 and 48.

It will also be appreciated that such bending does not unnecessarily consume a power supplied to the system by the motor 38 in that the rod 44 acts like a spring and except for the very slight hysteresis loss incurred within the rod 44 during such bending, all of the energy supplied to the rod 44 to bend the same during operation of the apparatus is returned to the system.

The system is particularly advantageous in that the ends 46 and 48 are fixedly secured to the respective shafts 24 and 30 and thus do not require thrust bearings or the like capable of carrying extremely large axial loads incurred during the operation of such apparatus and necessary in prior art devices to allow relative rotation between the components.

In those instances where the hollow bore 24 within the shaft 20 is used as a conduit to the port 26, the enlarged end 46 may be provided with one or more axial passages 52 to allow the axially outer end 54 of the shaft 20 to serve as a port 56 for connection to some part of the system in which the device is used.

In constructing the apparatus, the rod 44 cannot be made so thick as to resist bending to the point where the vanes 16 and 18 separate. At the same time, it cannot be made so thin as to insufficiently resist the tendency to axially elongate and thereby allow axial separation between the scroll plates 10 and 12.

While actual parameters for the rod will vary from application to application depending upon the size of the scrolls, the geometry of the vanes 16 and 18 employed, materials of which the components are fabricated, etc. in an apparatus scaled approximately is shown in the FIGURE, a length of eight inches and a diameter of 0.2 inches was found to be effective.

From the foregoing, it will be appreciated that a scroll-type apparatus made according to the invention achieves the object of simplicity and reliability in terms of providing a means to resist axial separation of the scrolls.

I claim:

1. Positive displacement apparatus of the scroll type comprising:

first and second scrolls in side by side relation and each having at least one generally spiral shaped vane;

said vanes interfitting to define at least one closed pocket at their interface which is movable between ports at positions centrally of the scrolls and peripherally thereof;

means mounting said scrolls so that one scroll at least orbits with respect to the other to move said pocket between said ports;

means for orbiting said one scroll; and a tension rod extending between said scrolls having its opposite ends fixedly secured to respective ones of said scrolls.

2. The positive displacement apparatus of claim 1 wherein said rod is located centrally of said scrolls.

3. The positive displacement apparatus of claim 1 wherein said rod is elongated and extends to either side of said scrolls.

4. Positive displacement apparatus of the scroll type comprising:

first and second scrolls in side by side relation and each having at least one generally spiral shaped vane;

said vanes interfitting to define at least one closed pocket at their interface which is movable between ports at positions centrally of the scrolls and peripherally thereof;

means, including a hollow shaft secured to each of said scrolls generally centrally thereof, mounting said scrolls for rotation and so that one scroll orbits with respect to the other to move said pocket between said ports;

means for rotating both scrolls and for orbiting said one scroll; and an elongated tension rod extending between said scrolls and having its opposite ends disposed in respective ones of said hollow shafts at locations remote from said interface, said ends being fixedly and nonrotatably secured to the associated shaft;

one of said shafts and said rod defining a relief intermediate said ends so that said rod will not abut said shafts or said scrolls as said one scroll orbits with respect to the other scroll.

5. The positive displacement apparatus of claim 4 wherein said relief is defined by a reduced diameter portion on said rod and located intermediate said ends.

6. Positive displacement apparatus of the scroll type comprising:

first and second scrolls in side by side relation and each having at least one generally spiral shaped vane;

said vanes interfitting to define at least one closed pocket at their interface which is movable between ports at positions centrally of the scrolls and peripherally thereof;

means mounting said scrolls to effect relative orbital motion between said scrolls to move said pocket between said ports, said mounting means comprising at least one hollow shaft secured to one of said scrolls oppositely of said interface and opening thereto by an aperture centrally of said one scroll;

means for causing relative orbiting movement of said scrolls; and an elongated tension rod having one end received within said hollow shaft and fixedly secured thereto remote from said interface and extending through said interface to be fixedly secured to the other of said scrolls, said tension rod being free to bend within said shaft as said scrolls undergo relative orbited movement.

7. The positive displacement apparatus of claim 6 wherein said aperture further serves as one of said ports and said hollow shaft serves as a conduit extending to said port, the end of said rod secured within said shaft being enlarged and including at least one passage in fluid communication with the interior of said hollow shaft.

* * * * *